US005833078A

United States Patent [19]

York

[11] Patent Number: 5,833,078

[45] Date of Patent: Nov. 10, 1998

[54] MODULAR SNOWBOARD STORAGE SYSTEM

[76] Inventor: Randall York, 3050 Spruce, Reno, Nev. 89511

[21] Appl. No.: 642,119

[22] Filed: May 2, 1996

[51] Int. Cl.[6] ..... A47F 7/00

[52] U.S. Cl. ..... 211/70.5; 211/87.01; 248/309.1; 248/176.1; D6/552

[58] Field of Search ..... 211/70.5, 87.01, 211/175, 88.01; 248/309.1, 176.1, 174; D6/552

[56] References Cited

U.S. PATENT DOCUMENTS

| | | | |
|---|---|---|---|
| D. 294,790 | 3/1988 | York . | |
| D. 298,499 | 11/1988 | York | D6/552 |
| D. 337,980 | 8/1993 | Ng . | |
| D. 350,109 | 8/1994 | Ruffolo . | |
| 3,289,852 | 12/1966 | Kahn | 248/309.1 X |
| 3,685,667 | 8/1972 | Bell | 211/70.5 |
| 4,646,922 | 3/1987 | Smith | 248/174 X |
| 4,678,087 | 7/1987 | York . | |
| 4,690,467 | 9/1987 | Imbert | 211/60.1 X |
| 4,715,502 | 12/1987 | Salmon | 211/175 X |
| 4,988,007 | 1/1991 | Chiarot | 211/70.5 |
| 5,082,123 | 1/1992 | Lamb . | |
| 5,344,056 | 9/1994 | Challoner . | |
| 5,383,587 | 1/1995 | Carpenter . | |
| 5,390,837 | 2/1995 | Ruffolo . | |

*Primary Examiner*—Donald P. Walsh
*Assistant Examiner*—Emmanuel M. Marcelo
*Attorney, Agent, or Firm*—Knobbe, Martens, Olson & Bear LLP

[57] ABSTRACT

A modular snowboard storage system, the modules of which can be connected end to end to form an extended linear storage system which can be mounted to a vertical surface, or interconnected at angles using angular or polygonal connectors to form free-standing storage systems having a variety of shapes. Each module has front and back walls having windows therethrough. The windows are specially shaped to removably retain the upturned longitudinal tip of a snowboard, in order to support the snowboard in a vertically upright position. The modular system provides for closely-packed storage of snowboards without damaging the snowboards or allowing adjacent snowboards to become entangled.

66 Claims, 4 Drawing Sheets

MODULAR SNOWBOARD STORAGE SYSTEM

BACKGROUND OF THE INVENTION

The present invention relates to a storage system for storing snowboards in a densely packed, vertically upright position.

The sport of snowboarding has become very popular in recent years, and its popularity continues to grow rapidly. Snowboarders generally practice the sport at ski resorts. When snowboarders at a resort go indoors, for example to socialize or eat a meal, they normally store their snowboards outdoors. Although resorts often provide racks for the storage of skis, these racks are generally not suitable for storing snowboards.

As a result of this lack of storage space, snowboards are often left strewn about near the entrance to a ski lodge or dining facility, creating a safety hazard for those entering or exiting the facility. Snowboards are also commonly leaned against vertical surfaces, such as a wall, window or tree, creating the risk that the snowboard will fall over, possibly injuring a bystander, causing damage to the snowboard or other property, or producing a domino effect on adjacent snowboards or skis. Moreover, when such informal storage methods are used, it is often difficult or impossible to lock a snowboard, creating a risk of theft.

At many ski resorts, the space available for snowboard storage is relatively small compared with the number of snowboards that must be stored at any time. This shortage of space is compounded by the fact that snowboarders find it convenient to store their boards as close as possible to the entrance to a facility. The informal snowboard storage methods are generally inefficient in terms of space, with the result that many resorts are experiencing a problem with overcrowding of snowboards. Thus, a snowboard storage system is needed that is safer and more efficient than the traditional, informal storage methods.

The amount of wall space or other vertical surfaces at ski resorts is limited, so there is a need for a free-standing snowboard storage system in addition to a storage system that can be mounted on vertical surfaces.

Snowboard storage capacity requirements vary with time. As snowboarding becomes more popular, the need for snowboard storage capacity will grow at many resorts. In addition, storage capacity requirements vary seasonally, and can vary as a result of scheduled events, such as snowboarding competitions. Thus, there is a need for a snowboard storage system having relatively small, lightweight components that can quickly and easily be disassembled, moved and reassembled in various configurations.

Snowboards come in a variety of lengths, widths and thicknesses, and there is therefore a need for a storage system that can accommodate significant variation in snowboard dimensions, while also meeting the foregoing requirements.

Because snowboarding is normally practiced at ski resorts, there is a need for a snowboard storage system that is interconnectable with existing ski storage systems.

Because most ski resort operators are concerned with the physical appearance of their facility, an additional need exists for a snowboard storage system that meets the foregoing requirements while being relatively compact and aesthetically pleasing, as well as being configurable into a variety of interesting and aesthetically pleasing shapes.

In addition to the need for stationary snowboard storage, snowboarders also need to transport their snowboards to the tops of ski slopes. It is inconvenient and hazardous for a person to carry a snowboard into a ski lift gondola and hold the board during the trip up the slope, due to the limited space inside the gondola to accommodate snowboarders, skiers, and their equipment. There is a therefore a need for a snowboard storage rack that can be secured to the exterior wall of a gondola.

There is also a need for snowboard storage on the exterior walls of automobiles, such as buses, in order to transport the boards to a ski resort. While ski resorts often rent snowboards, most experienced snowboarders prefer to transport their own boards. It is often difficult and hazardous to store snowboards inside a moving vehicle, particularly when a single vehicle is used to transport multiple snowboarders, as when a bus transports a group of snowboarders to a ski resort.

Thus, there is a need for a snowboard storage system which can be wall-mounted, vehicle-mounted or free-standing, can store snowboards of a variety of dimensions in a closely packed fashion, can be easily transported, and can be quickly reconfigured to provide a range of storage capacities and a variety of storage rack configurations.

SUMMARY OF THE INVENTION

The present invention involves the use of a specially-shaped window in the wall of a snowboard rack. The window has a shape that receives the longitudinal tip of a snowboard so that the tip is removably seated in the window in order to support the snowboard in a vertically upright position. In a preferred embodiment, the window has an inverted T shape.

Another aspect of the present invention is the use of snowboard storage modules which store multiple snowboards. Each snowboard storage module preferably has a dove-tailed male connector or tenon at one end and a mating female connector or mortise on the other end, so that the units can be strung together in an end-to-end fashion to form a variable-length linear storage rack. The linear storage racks thus formed are suitable for mounting on a vertical surface such as the exterior wall of a ski lodge or the side panel of a bus or ski lift gondola.

The snowboard storage modules can also be used, either singly or in a linear series, to form a free-standing snowboard rack by use of removable supporting feet that can be attached at the longitudinal ends of the modules. With the use of angled adapters and/or polygonal adapters, the modules can be interconnected to create a snowboard storage rack having any of an unlimited variety of polygonal, zig-zag, cross-like, or other desired shapes.

Advantageously, the snowboard storage modules may be molded of polyurethane or other such plastic material which is sufficiently durable and rugged to resist scratching and gouging by snowboards, yet sufficiently yieldable so as not to damage the snowboards.

BRIEF DESCRIPTION OF THE DRAWINGS

These and other aspects of the invention will now be described with reference to drawings of preferred embodiments of the present invention which are intended to illustrate and not to limit the invention and in which.

DETAILED DESCRIPTION OF THE PREFERRED EMBODIMENTS

Figure 1:
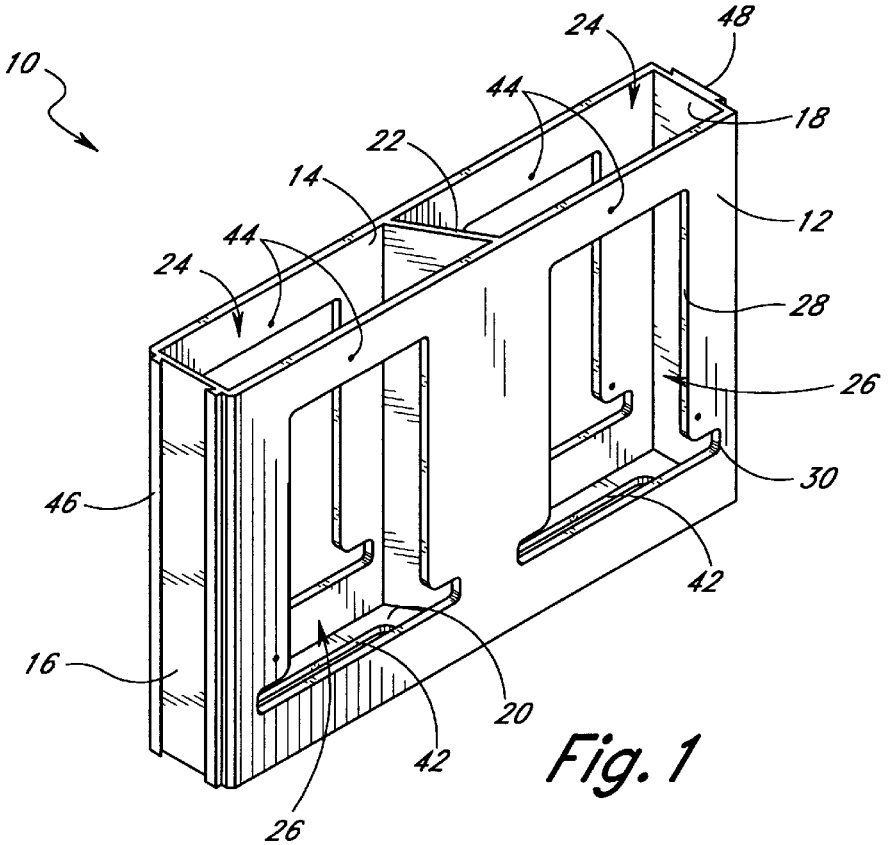
FIG. 1 is a perspective view of a single snowboard storage module in accordance with a preferred embodiment of the present invention.
Figure 2:
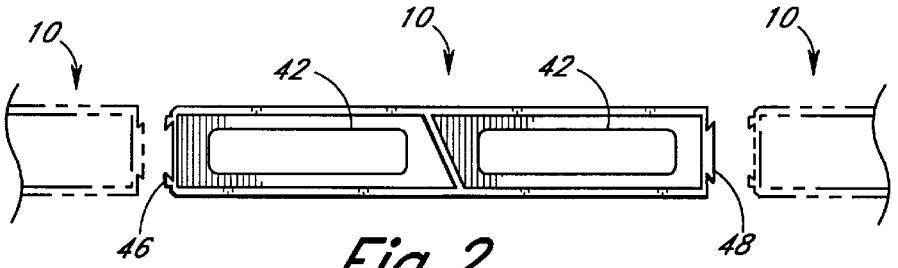
FIG. 2 is a top view of the storage module of FIG. 1.
Figure 3:
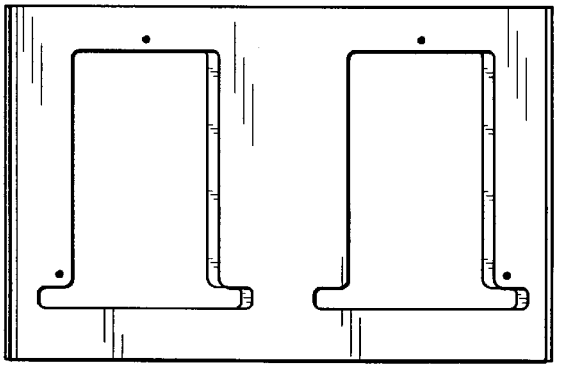
FIG. 3 is a front elevation view of the storage module of FIG. 1.

FIGS. 1–3 illustrate a snowboard storage module 10 comprising a front wall 12, a rear wall 14 preferably parallel to the front wall 12, side walls 16 and 18, a bottom wall 20, and a vertical dividing wall 22. The walls together form a pair of pockets 24 which are open at an upper end. The front and rear walls 12 and 14 each have a pair of cut-out portions or windows 26. Preferably, each of the windows 26 has somewhat of an inverted T shape comprising an upper rectangular portion 28 and a lower slot-like portion 30 that is wider than the upper portion 28. However, the windows 26 could alternatively be slot-shaped (e.g., the window 26 of the storage module 10 of FIG. 1 could consist solely of the slot 30 without the upper rectangular portion 28) triangular, semicircular, or any other shape that adequately retains the lower tip 34 of the snowboard 32 in place by the force of gravity.

Figure 4:
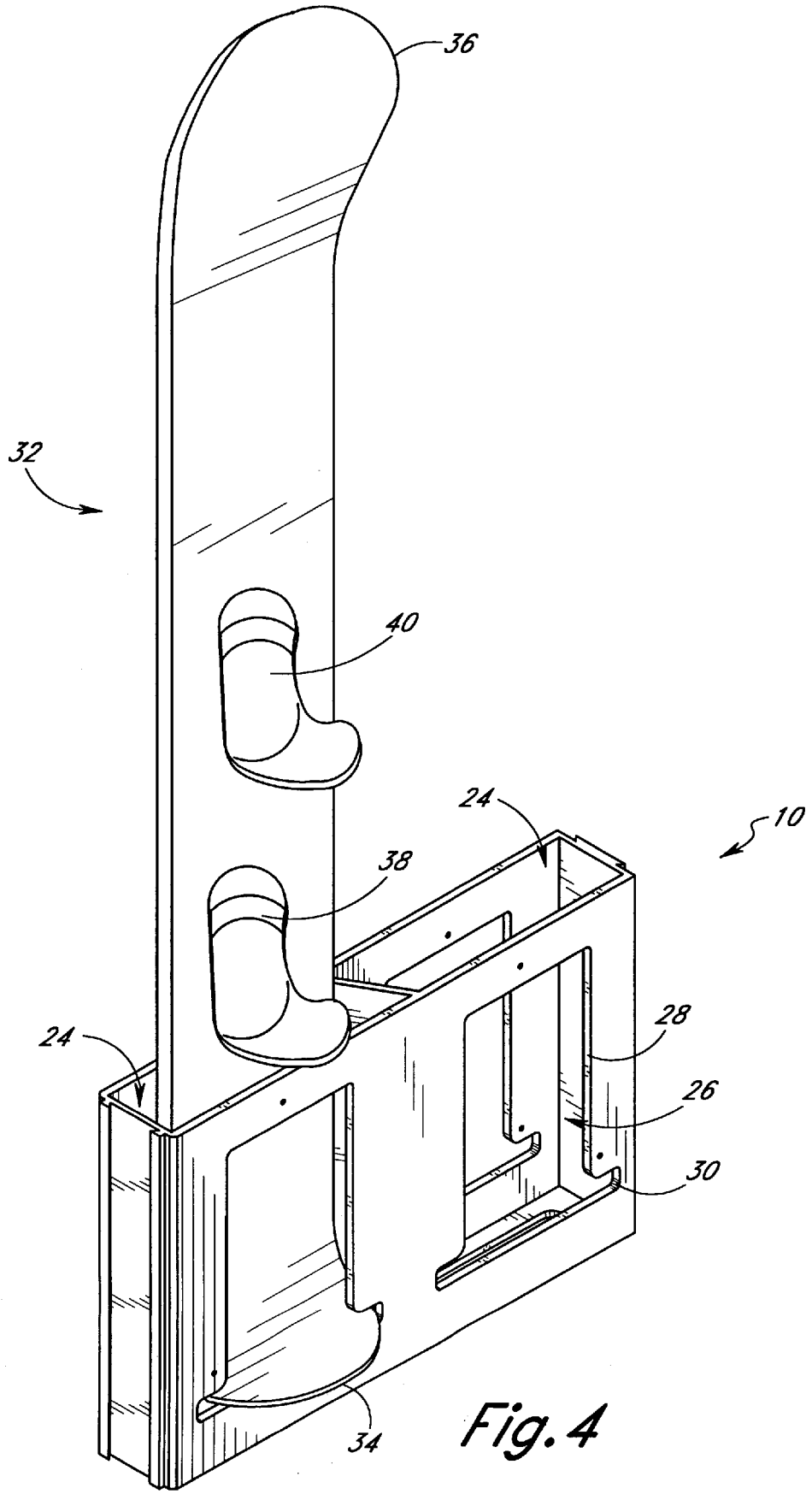
FIG. 4 is a perspective view of the storage module of FIG. 1 showing a snowboard supported therein.

FIG. 4 shows the use of the module 10 to store a snowboard 32. The generally long, flat snowboard has a pair of tapering, upturned tips 34 and 36, and a pair of bindings 38 and 40. To store the snowboard 32, the lower tip 34 of the snowboard 32 is introduced into one of the pockets 24. As the lower tip 34 is lowered into the pocket 24, the upper portion 28 of the window 26 helps to guide the lower tip 34 into the slot 30. The lower tip 34 of the snowboard 32 thereby becomes removably seated in the slot 30 so that a portion of the lower tip 34 protrudes through the slot 30 to the exterior of the storage module 10. The snowboard 32 is retained in this vertically upright position by its own weight, by the upper and lower edges of the slot 30, by the support of the front wall 12, and if necessary, by the support of the rear wall 14. When a second snowboard is placed in the storage module 10 back-to-back with the first snowboard 32, as described further below, the two snowboards also provide mutual vertical support.

The snowboard storage module 10 is preferably about 2 feet wide and about 4 inches deep. The storage module 10 preferably has a height equal to at least about one-fourth the height of a typical snowboard, and is preferably about 1.3 feet high. The front wall 12, rear wall 14, bottom wall 20, and dividing wall 22 are thin enough to ensure the storage module 10 is lightweight and easily movable, yet sufficiently thick to provide the module 10 with the durability and structural integrity required to withstand years of use. The walls 12, 14, 20 and 22 are preferably about 0.4 inches thick.

The pockets 24 of the storage module 10 preferably have the characteristic quadrilateral shape best shown in FIG. 2. Alternatively, any other polygonal, curved, or irregular shape could be utilized so long as adequate vertical support is provided to the snowboards being stored. The pockets 24 should be sufficiently deep to provide adequate vertical support to the snowboards so they will not inadvertently fall out of the module 10, or interfere with the insertion or removal of a snowboard in the same pocket or an adjacent pocket.

The vertical dividing wall 22 is preferably oriented at about a 60° angle to the front and rear walls 12 and 14. This orientation of the dividing wall 22 allows the storage module 10 to accommodate snowboards having a variety of widths, because the portion of each pocket 24 adjacent to the front wall 12 has a different width from the portion of the pocket 24 adjacent to the rear wall 14. With reference to FIGS. 1–3, the vertical dividing wall 22 divides the interior surface of the front wall 12 into two segments of unequal width. Each window 26 through the front wall 12 is preferably centered horizontally within one of these interior segments of the front wall 12. Similarly, the dividing wall 22 divides the interior surface of the rear wall 14 into two segments of unequal width, and the windows 26 through the rear wall 14 are also centered horizontally within these interior segments of the rear wall 14. This centering of the windows 26 helps to ensure that the snowboards stored within the pockets 24 of the snowboard storage module 10 will be centered on these interior segments of the front and rear walls 12 and 14, thereby allowing a storage module 10 of a given size to store wider snowboards than would be possible if the windows were not centered on the interior wall segments.

In addition to providing a seat for the upturned tip of a snowboard, the window 26 serves additional functions. For example, a cable (not shown) can be looped through one or more of the windows 26, secured to a snowboard, and locked together at its ends to deter theft of the snowboard. Also, the windows 26 reduce the quantity of material and the cost required to produce the storage module 10, reduce the overall weight of the storage module 10, and prevent snow, ice, and water from accumulating within the pockets 24.

With reference to FIG. 4, the window 26 preferably has a total height of about 11.5 inches. The upper rectangular portion 28 of the window 26 is narrower than the width of the snowboard 32, and is preferably about 6.5 inches wide. The slot 30 is wider than the upper portion 28 of the window 26, and is preferably about 9 inches wide. The slot 30 has a sufficient vertical height to receive the tips of snowboards having a variety of thicknesses, and is preferably about 1 inch high. The "height" of the slot 30 is defined as the vertical distance from the bottom of the window 26 to the shoulders that separate the slot 30 from the upper rectangular portion 28. The distance from the bottom of the slot 30 to the top edge of the module 10, preferably about 13 inches, and should be smaller than the distance from the lower tip 34 of the snowboard 32 to the bottom edge of the lower binding 38, so that when the snowboard 32 is positioned within the storage module 10, the binding 38 does not abut against the front wall 12, thereby interfering with the proper positioning of the snowboard 32. A snowboard having an upturned tip at either of its longitudinal ends, such as the snowboard 32 shown in FIG. 4, can be stored in a vertically inverted position from that shown in FIG. 4, so that the upper tip 36 is seated within the slot 30.

While only one snowboard is shown in FIG. 4, the storage module 10 has the capacity to store four snowboards—a first pair back-to-back in one of the two pockets 24, and a second pair back-to-back in the other pocket 24. When a snowboard such as the snowboard 32 in FIG. 4 is stored in the front portion of a pocket 24, the shape of the window 26 in the rear wall 14 makes its easier to insert a second snowboard back-to-back with the first, because the upper rectangular portion 28 of the rear window 26 will accommodate the upturned tip of the second snowboard as it is lowered into the pocket 24 to seat in the slot 30 of the rear window 26. The shape of the upper portion 28 of the windows 26 also makes it easier to remove one of two snowboards stored back-to-back in a pocket 24.

As described above, the snowboard storage module 10 preferably has side walls 16 and 18, a bottom wall 20, and a dividing wall 22. These walls provide structural integrity to the storage module 10. The walls also provide added safety, particularly where a snowboard module 10 is mounted above the ground, for example on the wall of a building or on the side of a bus or a ski lift gondola, because the walls help keep snowboards from falling to the ground, thereby possibly injuring passersby or damaging the snowboards or other property. For example, the bottom wall 20 prevents the snowboard 32 from sliding through the bottom of the storage module 10, in case the lower tip 34 of the snowboard 32 becomes dislodged from its seat within the slot 30 of the window 26, for instance due to a sudden disturbance in the motion of a vehicle to which the module 10 is mounted. The side walls 16 and 18 and the dividing wall 22 help prevent a snowboard from leaning over so far to one side as to cause the snowboard to fall out of the module 10, for example as a result of the sudden acceleration or deceleration of a vehicle to which the storage module 10 is mounted. Alternatively, any or all of the side, bottom, or dividing walls could be omitted from the storage module 10, as long as sufficient vertical support is provided to the snowboards being stored, and provided there is sufficient structural integrity to maintain the front and rear walls 12 and 14 in a parallel relationship to each other.

As best seen in FIG. 2, the bottom wall 20 has two drainage holes 42, one at the bottom of each of the pockets 24. The drainage holes 42 allow precipitation or snow that has melted from the skis to drain out of the pockets 42, so as not to accumulate therein. To aid this drainage, the bottom wall can include downwardly tapered portions (not shown) to direct liquid to the holes 42.

With further reference to FIG. 1, the front and rear walls 12 and 14 have a plurality of holes 44 therethrough. Bolts, screws, or other fasteners (not shown) can be used to secure the storage module to a vertical wall or to the side of a vehicle, such as a bus or a ski lift gondola, to allow snowboards to be transported without being taken inside the vehicle. When a storage module 10 is attached to a vertical surface by use of the holes 44, tubular spacers (not shown) that fit around a bolt (not shown), or other appropriate means can be used to leave a gap between the storage module 10 and the vertical surface to which it is attached. Such spacing means allow adequate space for the tip of a snowboard to protrude through the window 26 facing the mounting surface, and also allows adequate room for the bindings 38 and 40. Preferably, such tubular spacers or other spacing means provide a spacing between the module 10 and the wall of approximately 4 inches.

While the holes 44 in the preferred embodiment are shown in the front and rear walls 12 and 14, holes could alternatively be provided in the bottom wall 20 so that the snowboard storage module 10 can be secured to a horizontal surface, such as the ground or the floor of a building. Alternatively, any other appropriate means can be used to secure the module 10 in a vertically upright position.

As illustrated in FIG. 2, a series of storage modules 10 can be interconnected to form a linear snowboard storage rack of a desired length, by means of mating connectors on the ends of each snowboard storage module. On one end of each module, there is a female connector 46, and on the other end there is a mating male connector 48 which can be slidably engaged with the corresponding female connector of the adjacent module. Preferably, the female connector 46 is a dove-tail mortise, and the male connector 48 is a dove-tailed tenon which are vertically slidably engageable to form a dove-tail joint. While the storage module 10 is preferably has one female connector 46 and one male connector 48, as illustrated, storage modules could alternatively be formed having two male connectors or two female connectors.

Figure 5:
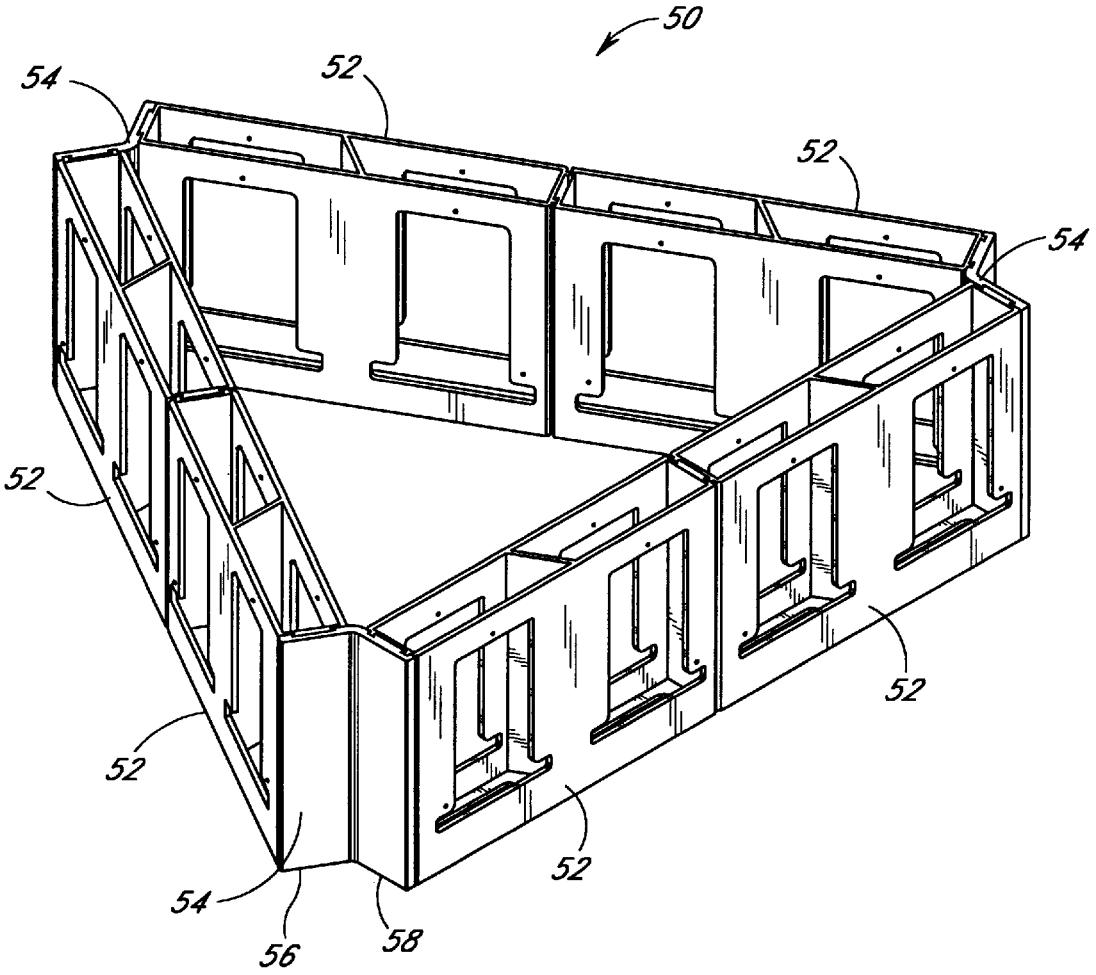
FIG. 5 is a perspective view of six storage modules as in FIG. 1 interconnected directly and by angular adapters to form a free-standing snowboard storage rack with a triangular configuration.
Figure 6:
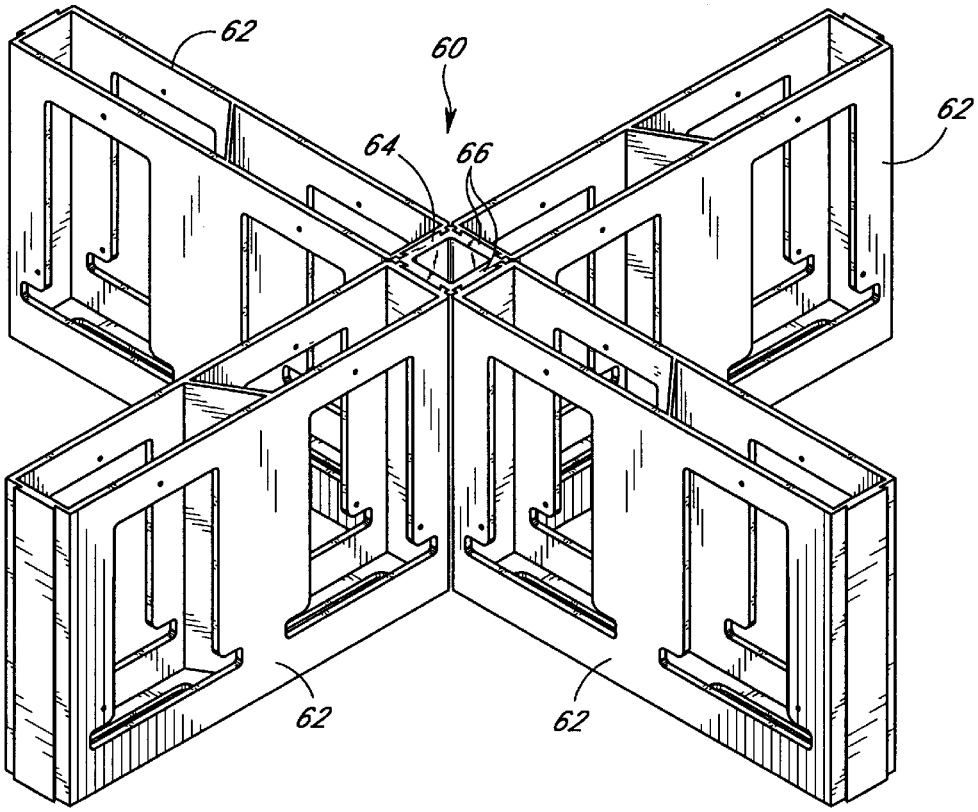
FIG. 6 is a perspective view of four storage modules as in FIG. 1 interconnected by a four-sided adapter to form a free-standing snowboard storage rack with a cross-like configuration.
Figure 7:
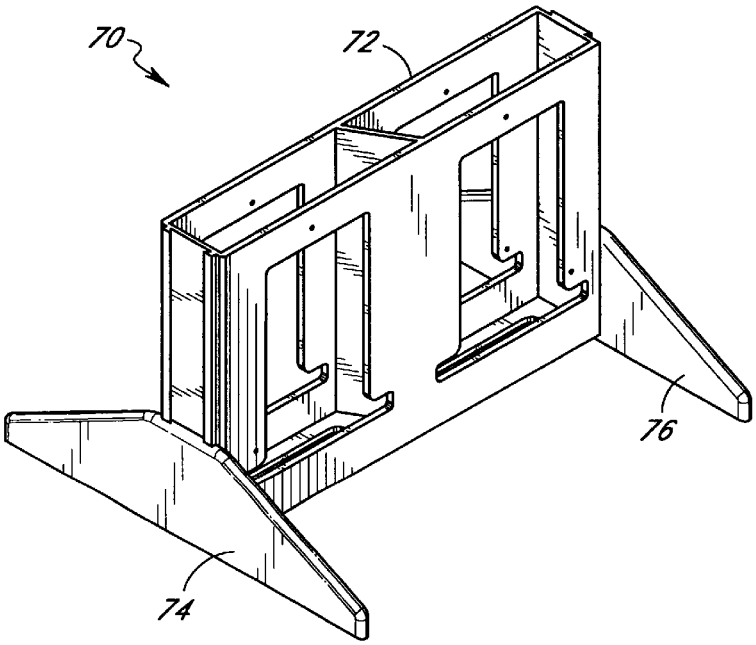
FIG. 7 is a perspective view of a storage module as shown in FIG. 1 with a pair of attached horizontal feet to form a free-standing snowboard storage rack.

With reference to FIGS. 5, 6, and 7, three different free-standing snowboard rack configurations 50, 60, and 70 are shown. Due to their inherently stable geometric shapes, the free-standing racks 50, 60 and 70 do not have to be fastened to a vertical surface in order to remain in a stable, upright position while storing a number of snowboards. Thus, the free-standing racks 50, 60 and 70 can easily be transported from one location to another, and are particularly well suited for locations where there is little or no vertical wall space on which the racks can be mounted. This ease of transportation of the racks 50, 60, and 70 is particularly important because it is not uncommon to encounter snow storms which are severe enough to completely bury a snowboard rack overnight. Thus, the free-standing snow racks 50, 60, and 70 can be frequently moved to accommodate changing depths of snow, and the subsequent grooming of the snow.

With reference to FIG. 5, a snowboard rack 50 is shown in a free-standing triangular shape, the legs of the triangle being formed by six snowboard storage modules 52. Each of the legs of the triangle is formed by a pair of storage modules 52, and the corners of the triangle are formed by means of angular adapters 54. The angular adapters are V-shaped brackets comprised of two straight legs 56 and 58 which are joined together at the apex of the V-shape to form an angle. One leg 56 has a female connector which interconnects to a mating male connector at the end of a snowboard module 52, and the other leg 58 has a male connector which interconnects with a mating female connector at the end of a snowboard module 52.

While the angular adapters 54 shown in FIG. 5 have a 120° angle, angular adapters could be formed with various angular orientations. The angle at which the legs of the adapter are spread will determine the angle formed by the adjacent connected snowboard modules, and therefore the polygon shape formed by the interconnected components. Also, the straight sides of the polygon can have varying lengths by connecting the storage modules together in a linear fashion, as in FIG. 2, as well as at an angular orientation with the use of the angular adapters.

For example, the use of three 120° angular adapters will result in an equilateral triangle, as shown in FIG. 5. Four 90° angular adapters will result in a square or rectangle, depending on the length of the sides. Irregular polygon shapes can be formed as well, by using adapters of various angles, and sides of various lengths.

Although not shown, the snowboard storage modules can be interconnected by means of angular adapters to form various zig-zag shapes which are unenclosed, but which are sufficiently stable to be free-standing and self-supporting.

With reference to FIG. 6, a snowboard rack 60 is shown in a free-standing cross-like configuration, the arms of the cross being formed by four snowboard storage modules 62. The center of the cross-shaped snowboard rack 60 is formed by a central polygonal adapter 64 having four side walls 66, each of which has a male connector which mates with a female connector at the end of one of the snowboard modules 62.

While a four-sided polygonal adapter 64 is shown in FIG. 6, polygonal adapters could be formed with three sides, or with five or more sides. Polygonal adapters could also be formed with side walls having female adapters, or having a mixture of male and female adapters, in order to provide greater flexibility in the variety of rack configurations that can be constructed. Also, the arms radiating from a central polygonal adapter can be constructed to have varying lengths, by connecting several storage modules together in a linear fashion, as in FIG. 2. Multiple polygonal adapters with various numbers of sides can be connected to arms of various lengths in order to create an unlimited variety of free-standing rack configurations.

With reference to FIG. 7, a snowboard rack 70 is shown in a free-standing solo configuration. The snowboard rack 70 comprises a single snowboard storage module 72, a male foot adapter 74, and a female foot adapter 76. The male foot adapter 74 has a male connector which mates with the female connector at the left-hand end of the snowboard module 72. The female foot adapter 76 has a female connector which mates with the male connector at the right-hand end of the snowboard module 72. Means (not shown) can be provided on the foot adapters 74, 76 to prevent the adapters from sliding up the snowboard module 72 from the positions shown in FIG. 7, thereby providing further stability to the snowboard rack 70.

While the rack 70 shown in FIG. 7 makes use of only a single storage module, a free-standing rack can be formed by interconnecting two or more storage modules in series, as in FIG. 2, and placing a foot adapter at either end of this series, so long as the serial rack can maintain its stability while storing a number of snowboards. In addition, while the foot adapters 74 and 76 shown in FIG. 7 have a male or female adapter only on one side, foot adapters could be formed with an adapter on both sides, either two male, two female, or one male and one female. Such two sided adapters could be used to create a long series of snowboard modules having greater stability than a serial rack having foot adapters only on its extreme ends.

A variety of angular adapters, polygonal adapters, and/or foot adapters, such as the adapters 54, 64, 74, and 76 shown in FIGS. 5–7 can be interconnected in various ways with single storage modules or modules connected in series, to create an unlimited variety of free-standing rack configurations. In this way, a rack can be designed to hold any number of snowboards, to fit into an available space of any shape, or to create a snowboard rack having a useful or aesthetically pleasing configuration.

Preferably, the snowboard module 10, as well as the adapters 54, 64, 74, and 76, are formed from a polymer material such as a polyurethane. The advantages of polyurethane are that it is a strong, durable, and rigid yet lightweight material which can withstand the extreme cold temperatures often encountered at ski resorts and other snowboarding locations. Polyurethane will not rust like metal, and snow does not stick to polyurethane even when cold. Another advantage of polyurethane is that it can be molded into the desired configuration with a minimum of labor intensive machining. Although polyurethane is rugged enough not to be gouged or otherwise damaged when struck with snowboards, skis, or other objects, polyurethane is sufficiently resilient that it will not damage or scratch snowboards or bindings. Polyurethane is also relatively non-absorbent, so that when it will resist staining when exposed to mud or other environmental materials. Polyurethane can also be permanently pigmented a variety of colors, and thus never needs painting.

As an alternative to polyurethane, the snowboard module 10, and the adapters 54, 64, 74, and 76 could be formed of any other suitable material, such as metal or wood. The storage module 10, and the adapters 54, 64, 74, and 76 could also be mass-produced relatively inexpensively by an injection molding process using a polycarbonate material. Such a polycarbonate material could be used, for example, to produce relatively inexpensive snowboard racks for the retail consumer market.

Preferably, the snowboard module 10, as well as the adapters 54, 64, 72, and 76, are all interconnectable with the ski storage systems disclosed in U.S. Pat. Nos. 4,678,087 and Des. 294,790, both of which are incorporated herein by reference. By maintaining compatibility with these ski storage systems, snowboard storage racks of various configurations can be interconnected with ski racks to facilitate the efficient, convenient, and safe storage of both snowboards and skis in a single rack configuration.

Although this invention has been described in terms of certain preferred embodiments, other embodiments apparent to those of ordinary skill in the art are also within the scope of this invention. Thus, while preferred embodiments have been described in terms of a snowboard storage module having a storage capacity of four snowboards, the present invention could also be embodied in other configurations with capacities ranging from one snowboard to five or more snowboards. For example, the present invention could be embodied in a single wall having one or more inverted T-shaped windows like the windows 26 of FIG. 1, and having holes therein to facilitate attachment to a vertical building surface or the side of a vehicle. The present invention could also be embodied in a snowboard rack having three or more parallel walls, each with several snowboard-supporting windows therein. In addition, while the above-preferred embodiments are discussed in relation to the snowboard 32 shown in FIG. 4, it will be apparent to those of ordinary skill in the art that a snowboard storage system according to the present invention can be configured to accommodate snowboards having a broad range of sizes and dimensions. It will also be understood by those of ordinary skill in the art that similarly configured objects other than snowboards can be used in conjunction with the present invention, such as snow skis and water skis. Accordingly, the scope of the invention is intended to be defined only by the claims which follow.

What is claimed is:

1. A snowboard storage system, comprising a vertical wall having a horizontal slot therethrough, said slot being a dimensioned and adapted to removably accept a tapered, upturned longitudinal tip of a snowboard to support the snowboard in a vertically upright position, said wall further having an opening therethrough, said opening being narrower than the width of said slot and extending upwardly from a portion of said slot.

2. A snowboard storage system as in claim 1, wherein said slot is about 1 inch high and about 9 inches wide.

3. A snowboard storage system as in claim 1, wherein said opening is rectangular and the width of said opening is less than the width of a typical snowboard.

4. A snowboard storage system as claimed in claim 3, wherein the width of said opening is about 6.5 inches.

5. A snowboard storage system as in claim 1, further comprising means to secure said wall in an upright position.

6. A snowboard storage system as in claim 5, including holes in said storage system through which fasteners may be inserted to attach said storage system to a surface.

7. A snowboard storage system as in claim 5, wherein said securing means comprises removable horizontal feet.

8. A snowboard system as in claim 1, wherein said storage system comprises snowboard storage modules adapted to be interconnectable in an end-to-end fashion to form an extended, linear storage system.

9. A snowboard storage system as in claim 8, wherein one end of each of said storage modules has a male connector, and the other end has a mating female connector.

10. A snowboard storage system as in claim 8, wherein said storage modules are adapted to be arranged to form various free-standing shapes of varying sizes by connecting the ends of the modules together at an angular orientation.

11. A snowboard storage system as in claim 8, wherein said storage modules are adapted to be interconnected by the use of polygonal adapters having multiple sides that are connectable to the ends of said storage modules.

12. A snowboard storage system as in claim 1, wherein said storage system is fabricated from a durable, moldable polymer material adapted to withstand extreme cold temperature and adapted to withstand impact with snowboards or skis or the like, without damage to the snowboard or skis, or be damaged itself.

13. A snowboard storage system, comprising:

a front wall having a plurality of windows therethrough, each of said windows being shaped and adapted to removably accept a tapered, upturned longitudinal tip of a snowboard, each of said windows having spaced upper and lower edges sized to engage the snowboard to support the snowboard in a vertically upright position and to limit the movement of the snowboard into the window;

a rear wall having a plurality of windows therethrough having shapes similar to the windows through said front wall; and a pair of side walls interconnecting said front and rear walls in a parallel relationship.

14. A snowboard storage system as in claim 13, further comprising a bottom wall interconnecting said pair of side walls and said front and back walls.

15. A snowboard storage system as in claim 14, wherein said bottom wall has at least one drainage hole therethrough.

16. A snowboard storage system as in claim 13, further comprising at least one vertical dividing wall interconnecting said front and rear walls between said pair of side walls.

17. A snowboard storage system as in claim 16, wherein the angle between said dividing walls and said front wall is approximately 60°.

18. A snowboard storage system as claimed in claim 16, wherein said front, rear, side and dividing walls together define a series of pockets, said pockets having a horizontal cross-sectional shape that allows said storage system to accommodate snowboards having a variety of widths.

19. A snowboard storage system as in claim 13, wherein said front wall has a plurality of holes therethrough to allow the snowboard storage system to be fastened to a vertical surface.

20. A snowboard storage system as in claim 13, wherein said rear wall has a plurality of holes therethrough to allow the snowboard storage system to be fastened to a vertical surface.

21. A snowboard storage system as in claim 13, wherein said front, rear, and side walls form part of a snowboard storage module adapted to be connected with other similar modules to form an extended, linear storage system.

22. A snowboard storage system as in claim 21, wherein one end of each of said storage modules has a male connector, and the other end has a mating female connector.

23. A snowboard storage system as in claim 21, wherein a plurality of said storage modules are adapted to be arranged to form various free-standing shapes of varying sizes by connecting the ends of the modules together at an angular orientation.

24. A snowboard storage system as in claim 21, wherein a plurality of said storage modules are adapted to be interconnected by the use of polygonal adapters having multiple sides that are adapted to be connected to an end of one of said storage modules.

25. A snowboard storage system as in claim 21, further comprising removable horizontal feet that are connectable to an end of one of said storage modules.

26. A snowboard storage system as in claim 21, wherein said storage module is appromixately 2 feet wide, 1.3 feet high, and 4 inches deep.

27. A snowboard storage system as in claim 13, wherein said storage system is fabricated from a durable, moldable polymer material adapted to withstand extreme cold temperature and adapted to withstand impact with snowboards or skis or the like.

28. A snowboard storage system, comprising:

a front wall having a plurality of windows therethrough, each of said windows shaped and adapted to removably accept a tapered, upturned longitudinal tip of a snowboard to support the snowboard in a vertically upright position;

a rear wall having a plurality of windows therethrough having shapes similar to the windows through said front wall; and a pair of side walls interconnecting said front and rear walls in a parallel relationship;

each of said windows having an inverted "T" shape comprising an upper rectangular portion and a lower, wider slot-like portion.

29. A snowboard storage system as in claim 28, wherein said window has a total height of about 11.5 inches, said upper rectangular portion is about 6.5 inches wide, and said slot is about 1 inch high and about 9 inches wide.

30. A snowboard storage system as in claim 28, wherein said windows have a height equal to at least one-half the total height of said front and rear walls, said upper rectangular portion is narrower than a typical snowboard, and said slot-like portion has a height greater than the thickness of the upturned longitudinal tip of a typical snowboard.

31. A snowboard storage system, comprising:

a front wall, a rear wall, a pair of side walls interconnecting said front and rear walls in a parallel relationship, and a vertical dividing wall interconnecting said front and rear walls between said pair of side walls, the angle between said dividing wall and said front wall being between 30° and 80°, said walls creating a pair of pockets on each side of said dividing wall with each pocket adapted to receive an end of at least one snowboard.

32. A snowboard storage system as in claim 31, further comprising a bottom wall interconnecting said pair of side walls and said front and back walls.

33. A snowboard storage system as in claim 32, wherein said bottom wall has at least one drainage holes therethrough.

34. A snowboard storage system as in claim 31, wherein the angle between said dividing wall and said front wall is approximately 60°.

35. A snowboard storage system as in claim 31, wherein said front wall has plurality of holes therethrough to allow the snowboard storage system to be fastened to a vertical surface.

36. A snowboard storage system as in claim 31, wherein said rear wall has a plurality of holes therethrough to allow the snowboard storage system to be fastened to a vertical surface.

37. A snowboard storage system as in claim 31, wherein said front, rear, and side walls form part of a snowboard storage module adapted to be interconnected with other similar modules to form an extended, linear storage system.

38. A snowboard storage system as in claim 37, wherein one end of each of said storage modules has a male connector, and the other end has a mating female connector.

39. A snowboard storage system as in claim 37, wherein a plurality of said storage modules are adapted to be arranged to form free-standing shapes of varying sizes by connecting the ends of the modules together at an angular orientation.

40. A snowboard storage system as in claim 37, wherein a plurality of said storage modules are adapted to be interconnected by the use of polygonal adapters having multiple sides that are adapted to be connected to an end of one of said storage modules.

41. A snowboard storage system as in claim 37, further comprising removable horizontal feet that are connectable to an end of one of said storage modules.

42. A snowboard storage system as in claim 37, wherein said storage module is approximately two feet wide, 1.3 feet high, and 4 inches deep.

43. A snowboard storage system as in claim 31, wherein said storage system is fabricated from a durable, moldable polymer material adapted to withstand extreme cold temperature and adapted to withstand impact with snowboards or skis or the like.

44. A snowboard storage system as in claim 31, wherein said front and rear walls have a plurality of windows therethrough, each of said windows being shaped and adapted to removably accept the tapered, upturned longitudinal tip of a snowboard to support the snowboard in a vertically upright position.

45. A snowboard storage system as in claim 44, wherein each of said windows has an inverted "T" shape comprising an upper rectangular portion and a lower, wider slot-like portion.

46. A snowboard storage system as in claim 44, wherein said dividing wall divides an interior surface of said front wall into two wall segments having unequal widths, each of said front wall segments having one of said windows therethrough, each of said windows being centered horizontally within one of said front wall segments, and wherein said dividing wall divides an interior surface of said rear wall into two wall segments having unequal widths, each of said rear wall segments having one of said windows therethrough, each of said windows being centered horizontally within one of said rear wall segments.

47. A snowboard storage system in combination with a snowboard comprising:

a snowboard having an elongated body and a tapered, upturned longitudinal tip; and a vertical wall having a window therethrough, said window comprises a substantially horizontal slot shaped and adapted to removably accept said longitudinal tip to support said snowboard in a vertically upright position.

48. A snowboard storage system as in claim 47, wherein said slot is about 1 inch high and about 9 inches wide.

49. A snowboard storage system as in claim 47, wherein said wall has an opening therethrough narrower than said slot and extending upwardly from a portion of said slot.

50. A snowboard storage system as in claim 49, wherein said opening is rectangular and has a width less than the width of said snowboard.

51. A snowboard storage system as in claim 50, wherein the width of said opening is about 6.5 inches.

52. A snowboard storage system as in claim 47, further comprising means to secure said wall in an upright position.

53. A snowboard storage system as in claim 52, including holes in said storage system shaped to receive fasteners to attach said storage system to a surface.

54. A snowboard storage system as in claim 52, wherein securing means comprises removable horizontal feet.

55. A snowboard system as in claim 47, wherein said storage system comprises snowboard storage modules adapted to be interconnected in an end-to-end fashion to form an extended, linear storage system.

56. A snowboard storage system as in claim 55, wherein one end of each of said storage modules has a male connector, and the other end has a mating female connector.

57. A snowboard storage system as in claim 55, wherein said storage modules are adapted to form various free-standing shapes of varying sizes by connecting the ends of the modules together at an angular orientation.

58. A snowboard storage system as in claim 55, wherein said storage modules are adapted to be connected by the use of polygonal adapters having multiple sides that are adapted to be connected to the ends of said storage modules.

59. A snowboard storage system as in claim 47, wherein said storage system is fabricated from a durable, moldable polymer material adapted to withstand extreme cold temperature and withstand impact with snowboards or skis or the like.

60. The system of claim 47, wherein said snowboard has an upturned end opposite from said tip.

61. A method for storing snowboards comprising the step of: inserting a tapered, upturned longitudinal tip of a snowboard into a horizontal slot dimensioned and adapted to removably accept said longitudinal tip, said slot having upper and lower spaced edges to support the snowboard in a vertically upward position and to limit movement of the snowboard into the slot.

62. A method for storing snowboards as in claim 61, further comprising the step of removing said longitudinal tip from said slot.

63. A method for storing snowboards comprising the step of:

inserting a tapered, upturned longitudinal tip of a snowboard into a horizontal slot dimensioned and adapted to removably accept said longitudinal tip to support the snowboard in a vertical position; and guiding said longitudinal tip into said slot by means of an opening through said wall narrower than said slot and extending upwardly from a portion of said slot.

64. A method for storing snowboards, comprising the steps of:

inserting a longitudinal end of a snowboard into a pocket formed in a snowboard storage system, said pocket being formed by a front wall, a rear wall, and a pair of side walls interconnecting said front and rear walls in parallel relationship, one of said side walls being angled with respect to the front and rear walls so that said pocket has a horizontal cross-sectional shape that is wider adjacent one of said front and rear walls than the other of said front and rear walls, said pocket being sized to receive a second snowboard with one of said snowboard ends being positioned adjacent said front wall and the other of said snowboard ends being positioned adjacent said rear wall whereby the cross-sectional shape allows said storage system to accommodate snowboards having a variety of widths.

65. A method of storing snowboards comprising the step of inserting a longitudinal end of a snowboard into one of two pockets formed in a snowboard storage system, said pockets being formed by a front wall, a rear wall, a pair of side walls interconnecting said front and rear walls in a parallel relationship, and a vertical dividing wall interconnecting said front and rear walls between said pair of side walls, the angle between said dividing wall and said front wall being between 30° and 80°.

66. A method of storing snowboards as in claim 65, further comprising the step of inserting a longitudinal end of a second snowboard in said pocket along with said first snowboard.

* * * * *